US009045843B2

(12) United States Patent
Andreacchi et al.

(10) Patent No.: US 9,045,843 B2
(45) Date of Patent: Jun. 2, 2015

(54) ELECTROPOLISHING FIXTURE WITH LEVER ARM

(75) Inventors: Anthony S. Andreacchi, San Jose, CA (US); Randolf von Oepen, Aptos, CA (US); William E. Webler, San Jose, CA (US); Rodney Charles Ow, San Jose, CA (US)

(73) Assignee: ABBOTT CARDIOVASCULAR SYSTEMS, INC., Santa Clara, CA (US)

( * ) Notice: Subject to any disclaimer, the term of this patent is extended or adjusted under 35 U.S.C. 154(b) by 37 days.

(21) Appl. No.: 13/618,455

(22) Filed: Sep. 14, 2012

(65) Prior Publication Data

US 2014/0076720 A1 Mar. 20, 2014

(51) Int. Cl.
*C25F 7/00* (2006.01)
*C25F 3/16* (2006.01)

(52) U.S. Cl.
CPC .... *C25F 3/16* (2013.01); *C25F 7/00* (2013.01)

(58) Field of Classification Search
CPC ..... C25F 3/16–3/28; C25F 7/00
See application file for complete search history.

(56) References Cited

U.S. PATENT DOCUMENTS

| | | | | |
|---|---|---|---|---|
| 4,127,459 | A * | 11/1978 | Jumer | 205/686 |
| 7,208,070 | B2 * | 4/2007 | Swain | 204/286.1 |
| 7,252,746 | B2 | 8/2007 | Schaeffer | |
| 2004/0267351 | A1 | 12/2004 | Swain | |
| 2005/0098444 | A1 | 5/2005 | Schaeffer | |
| 2007/0034527 | A1 | 2/2007 | Diaz et al. | |
| 2007/0034528 | A1 | 2/2007 | Diaz et al. | |
| 2007/0156215 | A1 | 7/2007 | Jensen et al. | |
| 2007/0209947 | A1 | 9/2007 | Shrivastava et al. | |
| 2008/0312747 | A1 | 12/2008 | Cameron et al. | |
| 2009/0255827 | A1 | 10/2009 | Andreacchi et al. | |
| 2011/0247943 | A1 | 10/2011 | Bialas et al. | |
| 2012/0199489 | A1 | 8/2012 | Vacheron | |
| 2014/0360887 | A1 | 12/2014 | Andreacchi et al. | |

FOREIGN PATENT DOCUMENTS

JP H0790694 4/1995

OTHER PUBLICATIONS

U.S. Appl. No. 13/618,407, filed Sep. 14, 2012, Andreacchi.
U.S. Appl. No. 13/618,348, filed Sep. 14, 2012, Andreacchi et al.
U.S. Appl. No. 13/617,877, filed Sep. 14, 2012, Andreacchi et al.
U.S. Appl. No. 13/618,348, Dec. 19, 2013, Office Action.
U.S. Appl. No. 13/617,877, Dec. 20, 2013, Office Action.
U.S. Appl. No. 13/618,348, filed Sep. 14, 2012, Anthony S. Andreacchi, Apr. 16, 2014, Notice of Allowance.
U.S. Appl. No. 13/617,877, filed Sep. 14, 2012, Anthony S. Andreacchi, Apr. 18, 2014, Office Action.
U.S. Appl. No. 13/618,348, filed Sep. 14, 2012, Anthony S. Andreacchi, Aug. 6, 2014, Issue Notification.
U.S. Appl. No. 13/617,877, filed Sep. 14, 2012, Anthony S. Andreacchi, Sep. 23, 2014, Office Action.
U.S. Appl. No. 13/618,407, Dec, 2, 2014, Office Action.

* cited by examiner

*Primary Examiner* — Nicholas A Smith
*Assistant Examiner* — Brian W Cohen
(74) *Attorney, Agent, or Firm* — Workman Nydegger; Jonathan D. Feuchtwang

(57) ABSTRACT

An electropolishing system that includes electropolishing fixtures. The electropolishing fixtures include pendulum assemblies configured to establish electrical contact between a device being electropolished and an anode and to reposition the device during the electropolishing process.

19 Claims, 12 Drawing Sheets

ELECTROPOLISHING FIXTURE WITH LEVER ARM

BACKGROUND OF THE INVENTION

Medical devices are an important part of the health industry and are responsible for the health of many people. Many life-saving procedures can be performed today because of advances in medical device technology. Stents, for instance, are examples of medical devices that are used in a variety of medical procedures. When stents are used in the context of the vascular system, they can prevent, open, or counter act the flow of blood in situations where a patient's vasculature is weak or blocked. Stents are not limited, however, to the vasculature system and can be employed in many systems and circumstances.

The production of medical devices such as stents can be a complicated process. Producing the stent includes forming struts that are arranged to provide strength and flexibility to the stent. The struts can be formed, for example, by laser cutting.

Once the stent is formed, the stent needs to be polished. The stent is polished in order to remove the rough or sharp edges that may remain on the stent and to smooth the surface of the stent. As one can image, a stent with rough or sharp edges may have adverse effects if introduced into a patient's vasculature.

Electropolishing is an example of a method used to polish stents. Electropolishing is a common process that is usually performed by immersing the stents in an electrolytic bath. In conventional systems, however, maintaining a consistent surface finish can be difficult.

More specifically, electropolishing a stent often requires contact between the stent and an electrode. The contact points between the electrode and the stent surface, however, impedes electropolishing at the contact points. As a result, the stent may be polished at a different rate at or near the contact points compared to other areas of the stent. Ideally, a device being electropolished will remain immersed since it minimizes the risk of contamination to the stent surface. However, when manufacturing devices such as stents, it may be difficult to keep the stent immersed for the entire polishing process since there is also a need to rotate the stents throughout the electropolishing process. By rotating the stent, the contact area between the stent surface and the anode conductor is varied, which ensures that the entire stent surface will be polished. Existing methods of producing this rotation while the stent remains immersed are insufficient because the pressure required to clamp a stent on an anode and provide good electrical contact can be excessive and can result in damage to the stent structure when the stent is rotated.

BRIEF SUMMARY OF THE INVENTION

Embodiments of the invention relate to an electropolishing system that includes electropolishing fixtures. Each fixture is configured to press the devices being electropolished against an anode, which may be conductive, to establish electrical contact and to reposition the devices during the electropolishing process. The electropolishing system may simultaneously electropolish multiple devices, which may or may not be of the same size and/or shape.

In one example, a system for electropolishing devices includes a first row of electropolishing fixtures and a second row of electropolishing fixtures. Each of the electropolishing fixtures in the first and second rows are configured to reposition at least one device being electropolished. The system also includes an actuator configured to move the first and second rows of electropolishing fixtures such that the electropolishing fixtures reposition the devices being electropolished.

Each electropolishing fixture may be associated with its own actuator. Alternatively, the rows of electropolishing fixtures may be connected to a rocking arm such that one actuator is capable of moving all of the electropolishing fixtures.

Each electropolishing fixture includes one or more lever arms that are mounted in a frame. The frame is provided with a pivot point and each of the lever arms may rotate independently about the pivot point. Each lever arm includes a distal end configured to contact the devices being electropolished. Each lever arm also includes a proximal end, which may be counterweighted. The counterweighted proximal end causes the lever arms to rotate about the pivot point such that the distal ends press the devices being electropolished against an anode, which typically passes through a lumen of the device and which may be conductive. Movement of the electropolishing fixtures results in rotation of the devices about the anodes.

In one example a method for electropolishing stents includes loading a plurality of stents on a row of posts. The row of posts includes pairs of posts and each pair of posts includes a removably connected anode. The stents are loaded on the anodes. Then, the stents are immersed in an electrolytic bath and electropolished. During the electropolishing process, the stents are repositioned by corresponding electropolishing fixtures. Finally, the row of posts is removed from the bath and the stents are unloaded from the anodes.

These and other advantages and features of the present invention will become more fully apparent from the following description and appended claims, or may be learned by the practice of the invention as set forth hereinafter.

BRIEF DESCRIPTION OF THE DRAWINGS

To further clarify the above and other advantages and features of the present invention, a more particular description of the invention will be rendered by reference to specific embodiments thereof which are illustrated in the appended drawings. It is appreciated that these drawings depict only illustrated embodiments of the invention and are therefore not to be considered limiting of its scope. The invention will be described and explained with additional specificity and detail through the use of the accompanying drawings in which.

DETAILED DESCRIPTION OF THE PREFERRED EMBODIMENTS

Figure 1:
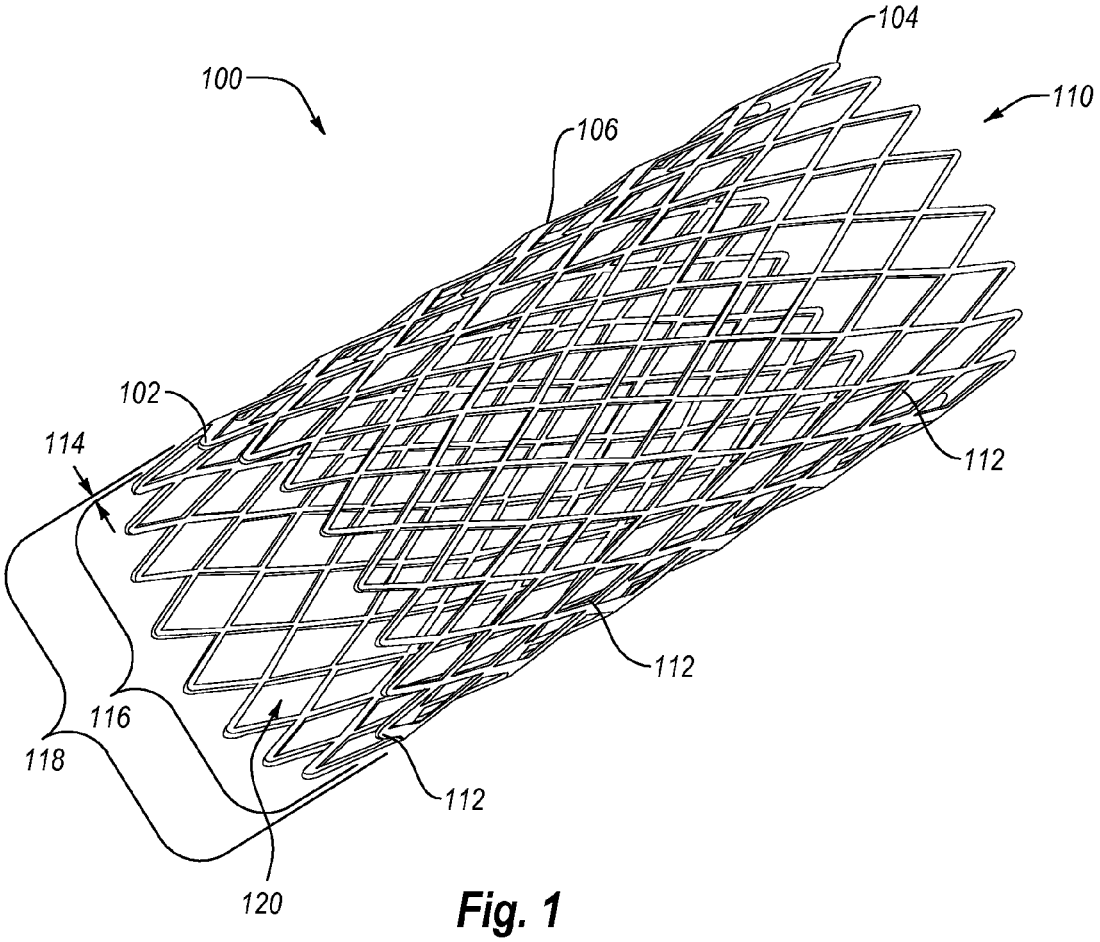
FIG. 1 illustrates a perspective view of an example medical device.

Embodiments of the invention relate to an electropolishing system that may include one or more electropolishing fixtures. Each electropolishing fixture may be configured for electropolishing devices including medical devices. Embodiments of the electropolishing fixtures include lever arms configured to place pressure against a device, electrode, or both during the electropolishing process. The lever arms may be electrically conductive and carry electrical current to the area of contact, or they may be insulated. In the latter case, the lever arms of the electropolishing fixture are operative to apply pressure between another conductive feature (e.g., an electrode or conductive mandrel) and the device. Embodiments of the invention are discussed in the context of a stent, which is an example of a medical device. Embodiments of the invention are applicable to the electropolishing of other devices as well.

When electropolishing a device such as a stent, the stent is placed over a mandrel, which may be conductive, and submerged in an electrolytic bath. The mandrel may be fixed against an electrode contact or may be configured as an electrode. Alternatively, the mandrel may be non-conductive or not configured to deliver electrical current to the stent.

In order to ensure adequate contact between the stent and the mandrel, the stent may be contacted by one or more lever arms that swing or rotate about a hinge component and that may be part of a pendulum assembly. In other words, the lever arms are arranged in a pendulum assembly.

The pendulum assembly can swing about the hinge, allowing the lever arms to come into contact with the stent regardless of the stent's exact radial or spatial location relative to the hinge. Furthermore, the pendulum assembly can also move in an upward and downward direction. The pendulum assembly may include counterbalances that are spaced a distance to the side of the hinges and that may be integrated into the lever arms. The counterbalances create a moment about the hinge that will cause the lever arms to rotate in a direction. More specifically, the lever arms of the pendulum assembly will tend to rotate into contact with the stent. In one embodiment, the counterbalances or another portion of the pendulum assembly may also act as electrical contacts so that the pendulum can be made to conduct electrical current from an electrical source into the stent.

When the pendulum assembly and in particular the lever arms are in contact with the stent and the pendulum assembly is then moved, the contact between the stent and the lever arms is sufficient to generate rotation of the stent about the electrode (or anode) on which the stent is loaded. The amount of pressure required to cause this rotation is minimal, and since the lever arms only contact one side of the stent, the risk of damaging the stent due to clamping force or rotation about the anode is also reduced. In effect, the wall of the stent is sandwiched between the electrode and the lever arms.

The pendulum assembly can also be scaled such that multiple stents and anodes may be integrated within a stent rack. Alternatively, multiple fixtures, each including a pendulum assembly, can be arranged to electropolish multiple stents. In one example, multiple stents can be accommodated on each anode. In this example, the stents can be placed on mandrels that are fixed to a frame of the stent rack. In addition, multiple pendulum assemblies may be used and placed in contact with the stents to enable the automated rotation of the stents. Each anode in the stent rack, for instance, may be associated with a particular pendulum assembly.

The placement of the cathode relative to the stent can also affect the electropolishing process. In one example, the stent frame may include a partition that can be positioned between the stent and the cathode. The partition assists in controlling a direction and flow of electrical current between the anode and the cathode. The cathode can be configured in many different configurations and shapes. For example, the cathode may include a conductive rod, mesh or screen that is positioned on an opposite side of the partition relative to the stent. The electrical current will be directed to pass through an opening or window in the partition in order to reach the cathode. Thus, the electrical field around the stent can be controlled as the current path reshapes to reach the cathode. The partition may include, for example, a narrow window or the like that approximates at least some dimensions of the stent and/or the cathode. For instance, a narrower window causes electrical current flowing from the stent to the cathode to focus in order to pass through the window and tends to cause the side of the stent facing the cathode to be preferentially electropolished. For instance, a shorter window (shorter than the stent length), centered on the stent tends to cause the ends of the stent to electropolish less than the central regions of the stent. These examples illustrate that the window in the partition can be configured to preferentially electropolish the stent. In addition, the location of the stent relative to the window can be changed during the electropolishing process such that, by way of example only, different portions of the stent can be preferentially electropolished at different times.

In another example, the cathode may be reconfigurable and adjustable. For example, the spacing of the cathode relative to the stent may be changed to affect the stent current flow. Spacing may be varied, by way of example only and not limitation, between about 0.38-inch and 0.75-inch. In addition to the spacing, the window of the cathode may be reconfigurable to change the current path and/or direction. The configuration of the window can be changed using sliding panels positioned between the stent and the cathode. By sliding the panels toward each other, the gap distance between the panels is reduced and less of the cathode is exposed. Alternatively, by separating the panels further apart, more of the cathode is exposed. These changes in distance and exposure result in an overall modification to the polishing characteristics of the stent, and allow for greater control of the polishing process.

Generally, at any given time during the electropolishing process, a side of the stent closest to the cathode will electropolish at a greater rate (e.g., mass removal rate) than the side of the stent the furthest away from the cathode and/or in contact with the lever arm. Thus, the operating characteristics of the electropolishing system can be controlled to more evenly electropolish stents. In some embodiments, the electropolishing current or voltage may be applied or turned on only when the stent is being rotated or repositioned. In some embodiments, short durations of current or voltage application without stent rotation may have insignificant effects. For instance, in many systems, the time for the stent rotation direction to reverse is not significant. In such embodiments, the electropolishing current or voltage may be applied, turned on or remain on when the stent is not being rotated or repositioned for short durations without significant effects. Furthermore, the stent may be rotated at a constant rate (rotational velocity) during electropolishing in some embodiments. Additionally, the stent may be rotated through multiple rotations during electropolishing. To make the electropolishing of the stent more even, the stent may be rotated in as near to whole rotations as practical. Additionally, the stent may be rotated both clockwise and counterclockwise and for the same number of rotations in each direction during electropolishing. Attention to and the careful selection/implementation of these operating conditions during stent electropolishing can cause the stent to be very uniformly electropolished. Testing has shown that stents electropolished under these conditions on fixtures as disclosed herein have more uniform dimensions than stents that are electropolished using a few (a practical number of) manual rotations on an interference fit anode (such as a tight-fit spiral mandrel) with cathodes that practically surround the stent.

Electrical current can be delivered to the stent in various ways. In one embodiment, the anode may also be the mandrel that holds the stent as previously discussed. In this example, the electrical current can be delivered into the stent directly through the mandrel, i.e. the anode. When the mandrel is also the anode, the lever arm or pendulum assembly may be an insulator and is not required to conduct electrical current. The pendulum assembly may be configured to impart rotational motion to the stent.

In an alternative embodiment, the mandrel may be insulated, which precludes the mandrel from also being an anode. In this example, the electrical current may be delivered into the stent through the pendulum, and through the lever arms of the pendulum assembly that are in contact with the stent. In either case, the anode may be connected to the power source using electrical connectors such as alligator clips or plugs.

The pendulum assembly can be configured in multiple variations. In one example, the pendulum assembly is configured to produce a horizontal load on the stent. The pendulum assembly may alternatively be configured to produce a vertical load on the stent.

A variety of mandrel or electrode configurations can be implemented. For example, the mandrel may be a sacrificial spiral mandrel. In the case of a sacrificial mandrel, the mandrel diameter may be slightly less than the inner diameter of the stent to allow the stent to rotate freely over its surface with minimal frictional loads. The mandrel may be made, for example, from a stainless steel or a nickel material, or some other inexpensive material. As a stent limiting stop, the mandrel may be overmolded with a polymeric bead or some other insulative material near one of its ends. This allows the stent to be placed over the mandrel and brought to a stop against the overmolded feature. Furthermore, the spiral mandrel may be sized to receive one or more friction fit spacers that can be brought near the end of a stent. The spacers may be insulative, such as formed from polymer or ceramic. Furthermore, the spacers may be configured to conform closely to the stent end. This may include a cup shape that conforms to and shields the stent ends.

As an alternative, a reusable spiral mandrel may be used. Such a mandrel would have a similar configuration to the sacrificial mandrel, but it would be constructed of more durable material. For example, the mandrel may be formed from Pt—Ir, Pt, Au, or any other conductive and durable material.

The pendulum assembly may include a counterbalanced lever arm that results in consistent pressure without the need for complex components that are susceptible to wear or deterioration under electropolishing conditions and thus, may require frequent adjustment and/or repair. In addition, embodiments reduce the need for tightly controlled alignment or spatial positioning between the lever arms and the stent/anode. This is useful because the acidic conditions tend to disrupt precise alignments due to wear and degradation of components. Additionally, the acid resistant fluorocarbon plastics that may be most easily formed or machined into components or used to coat components are difficult to machine or form with great dimensional precision and tend to deform over time due to stress relief, temperature changes or in response to applied forces.

Embodiments of the electropolishing fixtures and/or electropolishing methods disclosed herein can help reduce dimensional variability to a laser-cut stent, decrease stent handling damage and increase the throughput of the electropolishing process.

FIG. 1 illustrates a perspective view of an example medical device 100 and is referred to herein as a stent 100. The stent 100 includes a body 110 that is generally tubular in shape, although other shapes and configurations are contemplated. The stent 100 has a first end 102 and a second end 104 that oppose each other. The body 110 includes struts 106 that are arranged to provide, by way of example only, strength and flexibility to the stent 100.

The stent 100 may also have a thickness 114, an inner diameter 116 and an outer diameter 118. The difference between the inner diameter 116 and the outer diameter 118 defines the thickness 114 of the stent 100. Embodiments of the invention can more evenly polish the stent 100 such that at least some dimensions, such as the thickness 114 of the body 110 or the dimensions of the struts 106 are more uniform. The stent 100 also includes a lumen 120.

The stent 100 may be made of a material or alloy, such as Nitinol, stainless steel, cobalt-chromium, or the like, and has certain characteristics that facilitate operation of the stent. The stent 100 may be deformed (e.g., bent, compressed, expanded, or the like) by a force. For shape memory materials, when the force is removed, the stent 100 returns to its original shape. The elasticity and deformability of the stent 100 aid in the deployment of the stent 100 as well as in the operation of the stent 100.

While manufacturing the stent 100, the formation of the struts 106 or of the ends 102, 104 can often results in edges 112 or other areas that are rough, sharp or unsmooth. In addition, the thickness 114 may not be uniform and the inner surface and/or outer surface of the stent 100 may be rough.

Electropolishing the stent 100 smoothes the edges 112 as well as the surfaces of the stent 100. Polishing the stent 100 may prevent the stent 100 from causing problems once deployed. Electropolishing the stent 100 may also make the dimensions of the stent (thickness, strut dimensions, etc.) conform to the desired final dimensions and thus, for the stent 100 to attain its desired properties.

Figure 2:
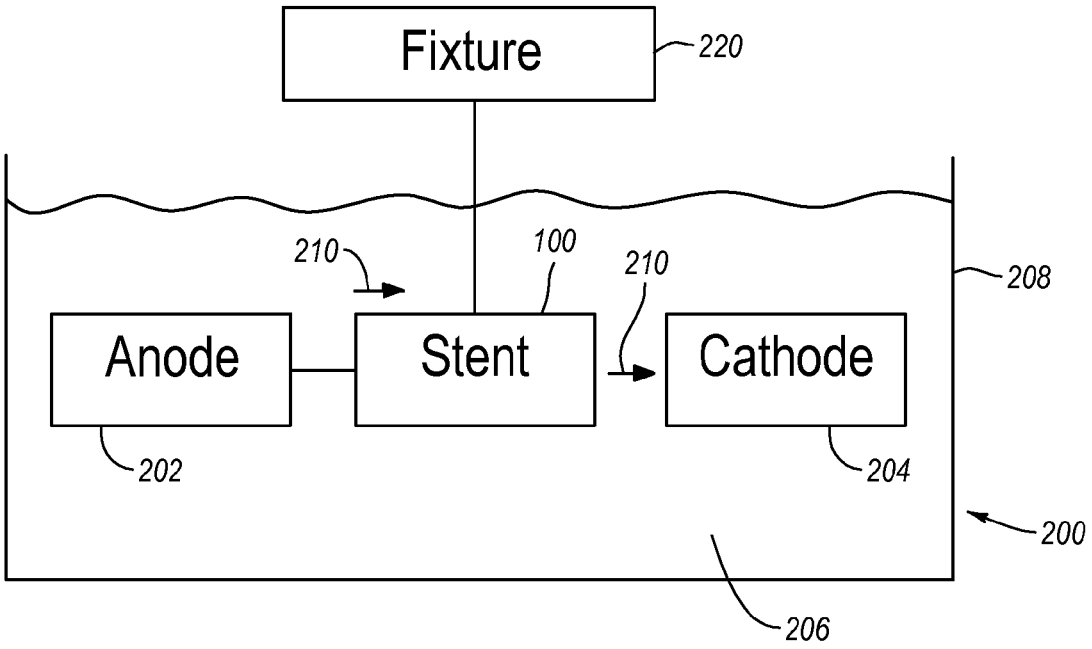
FIG. 2 illustrates a block diagram of an example system for electropolishing a medical device such as a stent.

FIG. 2 illustrates a block diagram of an example system 200 for electropolishing the stent 100 or other device. The system 200 includes a container 208 that holds an electrolytic bath 206. The system 200 electropolishes the stent 100 in the electrolytic bath 206 once the stent 100 is loaded on a fixture 220 (or on a mandrel) and immersed in the electrolytic bath 206.

During the electropolishing process, the stent 100 is usually fully immersed in the electrolytic bath 206 along with an anode 202 and a cathode 204. The anode 202 and the cathode 204 may be part of or separate from the fixture 220. Prior to immersion in the electrolytic bath 206 or after immersion in the electrolytic bath 206, the stent 100 is positioned such that the stent 100 comes into contact with the anode 202. The contact may be initially established by gravity.

The fixture 220 may include lever arms that press the stent 100 against the anode 202 when the stent is immersed in the bath 206. The fixture 220 may be configured such that the stent 100 can be removed from and immersed in the electrolytic bath 206. For example, the stent 100 may be loaded on the anode 202 outside of the electrolytic bath 206 and then immersed for the electropolishing process.

Once the stent 100, the anode 202 and the cathode 204 are immersed in the electrolytic bath 206, a current 210 is then applied. The current 210 flows from the anode 202 to the cathode 204 through the stent 100 and the electrolytic bath 206. In this manner, the stent 100 is electropolished.

More specifically, electropolishing uses electrochemical reactions to remove material from a surface of the stent 100. Electropolishing tends to remove stent material that has increased electrical current densities. Portions of the stent's surface that are rough (bumps, shards, etc.) tend to have higher electrical current densities and are thus removed during the electropolishing process. The surface of the stent 100 is smoothed and polished by the removal of material from the stent's surface.

The fixture 220 included in the system 200 is configured to position the stent 100 and/or reposition the stent 100 within the electrolytic bath 206. The fixture 220 can be controlled automatically and/or manually to position the stent 100 within the electrolytic bath 206 and reposition the stent 100 relative to the anode 202. The fixture 220 may be immersed wholly or partially within the container 208 and/or the electrolytic bath 206. Alternatively, the fixture 220 may be located outside of the container 208 as illustrated in FIG. 2. The fixture 220 may be configured to be at least partially placed into and lifted out of the electrolytic bath 206 and/or the container 208.

During the electropolishing process performed in the system 200, the stent 100 is typically in contact with an electrode such as the anode 202 as previously stated. As a result, the anode 202 establishes contact points between the anode 202 and the surface of the stent 100. The fixture 220 ensures that contact points exist between the anode 202 and an inner surface of the stent 100. The anode 202 can be configured with one or more locations that are configured to contact the stent 100 (e.g., establish a friction contact) and the contact points between the anode 202 and the stent 100 can be on an internal surface of the stent 100 and/or an external surface of the stent 100. Alternatively, the anode 202 may have a loose fit and the fixture 220 ensures that contact between the anode 202 and the stent 100 is established during the electropolishing process.

Current is supplied to the stent 100 through the anode 202. The cathode 204 is electrically connected with the stent 100 via the electrolytic bath 206. As a result, the current 210 flows to the cathode 204 through the electrolytic bath 206. Current flow from the surface of the stent 100 is facilitated in this manner in order to remove material from the stent and thereby smooth the stent surface during the electropolishing process.

Contact points or more generally contact regions corresponding to the locations of contact between the stent 100 and the anode 202 have little or no current flow from the stent surface into the electrolytic bath 206. As a result, the contact points or contact regions are not smoothed or polished in conventional systems or are not smoothed or polished at the same rate as other areas of the stent's surface.

The fixture 220 is configured to position the stent 100 to establish the contact regions between the stent 100 and the anode 202. In addition, the fixture 220 is configured or can be operated such that the stent 100 may be repositioned over time. As a result of being repositioned, the contact regions between the stent 100 an the anode 202 change during the electropolishing process and the overall finish of the stent 100 is improved. When the contact regions are exposed after repositioning the stent 100, current is then able to flow from the previous contact regions into the electrolytic bath 206 and to the cathode 204. As a result, the surface of the stent is more evenly smoothed by automatically and/or manually repositioning the stent 100 during the electropolishing process.

In addition, positioning or repositioning the stent 100 can also result in a stent having better or more uniform dimensions. Repositioning the stent 100 can remove bumps or other portions of the stents' surface that may be rough, such as at contact regions, resulting in more even dimensions.

FIG. 2 thus illustrates the stent 100 positioned on the anode 202 or anode contact. The anode 202 is effective to deliver current to the stent 100 during the electropolishing process. In addition, the stent 100 benefits from being repositioned while immersed within the electrolytic bath 206. Repositioning the stent 100 while the stent 100 is immersed prevents the stent 100 from being exposed to a more oxidizing environment and ensures more even erosion of the stent material during the electropolishing process.

Figure 3:
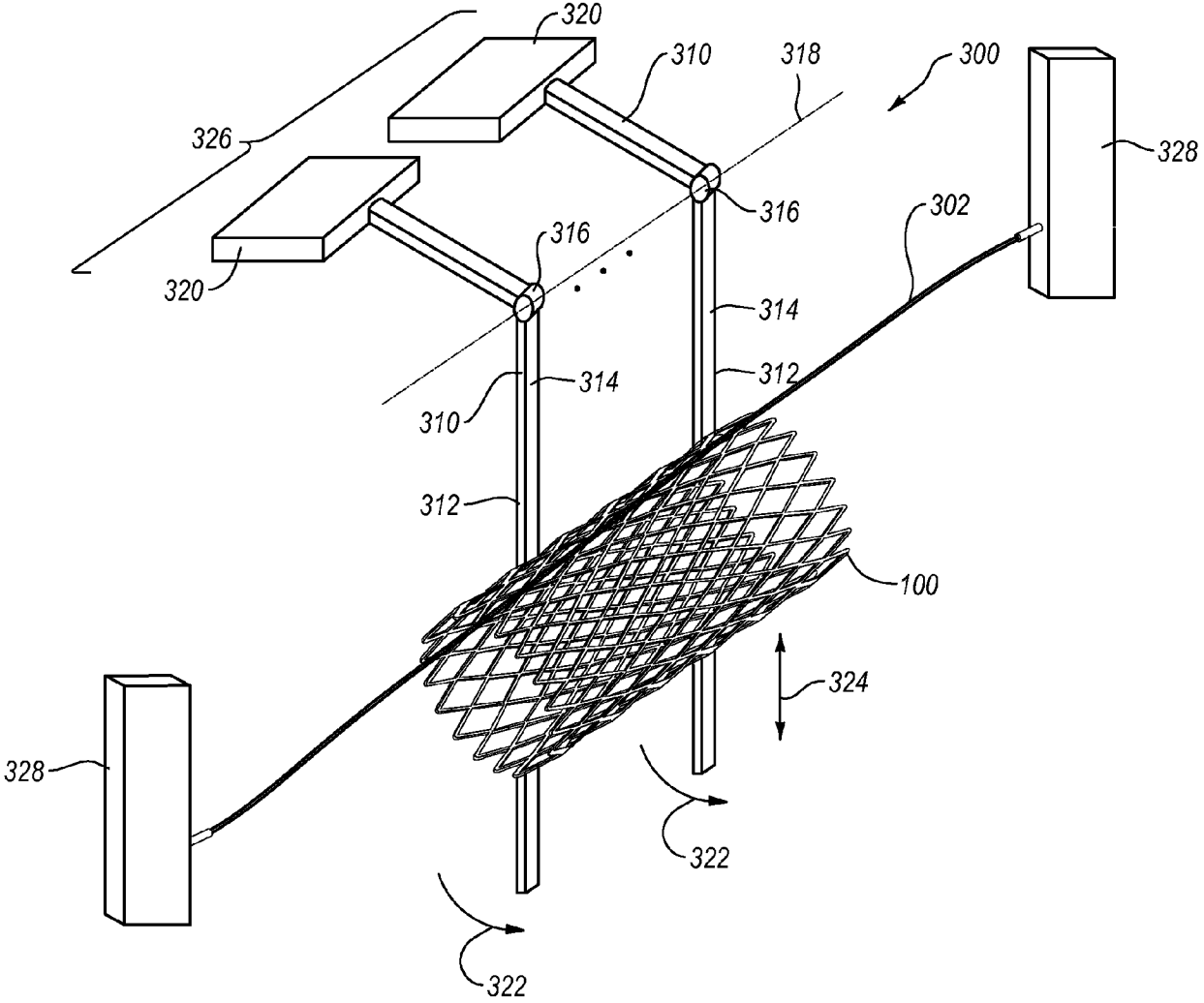
FIG. 3 illustrates a perspective view of a pendulum assembly of an electropolishing fixture that includes lever arms.

FIG. 3 illustrates a perspective view of a pendulum assembly 326 of an electropolishing fixture 300 that includes one or more lever arms 310. The fixture 300 is an example of the fixture 220. In FIG. 3, the stent 100 has been loaded on a mandrel 302. For example, the mandrel 302 is inserted through the lumen 120 of the stent 100. The mandrel 302 may be configured to operate as an anode. In this case, the lever arms 310 may be insulated and current is delivered through the mandrel 302 to the stent 100. Alternatively, the mandrel 302 may be insulated and current may be delivered to the stent 100 through the lever arms 310. At least one end of the mandrel 302 is removably connected to at least one of a frame or posts 328. The posts 328 are configured to keep the mandrel 302 adequately tensioned during the electropolishing process. The posts 328 may be included in the electropolishing fixture 300 and may be configured to provide an electrical source connection to the mandrel 302.

The fixture 300 is operable to move the stent 100 during the electropolishing process. The fixture 300 may be effective to establish electrical contact between the stent 100 and the anode 302. With electrical contact established, the fixture 300 may then cause the stent 100 to be repositioned. In one example, the stent 100 is rotated about the anode 302. Rotating the stent 100 or repositioning the stent 100 in this manner changes the contact points between the stent 100 and the anode 302. Changing the contact points enables the old contact points to be more effectively electropolished.

The fixture 300 may include the pendulum assembly 326. The pendulum assembly 326 includes one or more lever arms 310 that are mounted on an axis 318 (which may be part of a frame). The lever arms 310 include a counterweight 320, a pivot point 316, and a finger 312. The pivot point 316 may be connected with the axis 318 (e.g., a rod) or other suitable structure that enables the lever arm 310 to at least rotate about the pivot point 316. For example, lever arms 310 may be configured with an opening at the pivot points 316. The axis 318 is inserted through the openings, thereby enabling the lever arms 310 to rotate about the axis 318.

In the lever arms 310 (each pendulum assembly 326 may include one or more lever arms), the counterweight 320 may be acted on by gravity or by another force. The counterweight 320 has sufficient mass in one example to cause the lever arm 310 to rotate about the pivot point 316 and cause the fingers 312 to push against the stent 100 or, if appropriately positioned, against the mandrel 302.

The fingers 312 press the stent 100 against the mandrel 302 or electrode. The finger 312 pushes with sufficient force to establish adequate electrical contact during the electropolishing process between the stent 100 and the anode 302.

The finger 312 may have a textured surface 314. The textured surface 314 may be configured to engage the stent 100 more effectively than a smooth surface. The textured surface 314 may have teeth, roughness, grooves, a spongy or soft surface, or the like. The textured surface 314 may also be smooth.

The counterweights 320 of the lever arms 310 cause the fingers 312 to move radially (in the direction of arrow 322). The counterweights 320, as previously stated, push the fingers 312 against the stent 100. The fixture 300 is also configured to move the lever arms 310 vertically (or in another direction depending on the configuration of the fixture) in the direction of the arrow 324. The fingers 312 may contact the stent in a tangential manner. Movement in the tangential direction while the fingers 312 are pressed against the stent 100 by the counterweights 320 causes the stent 100 to rotate about the anode 302. As a result, the stent 100 is repositioned relative to the anode 302.

Figure 4:
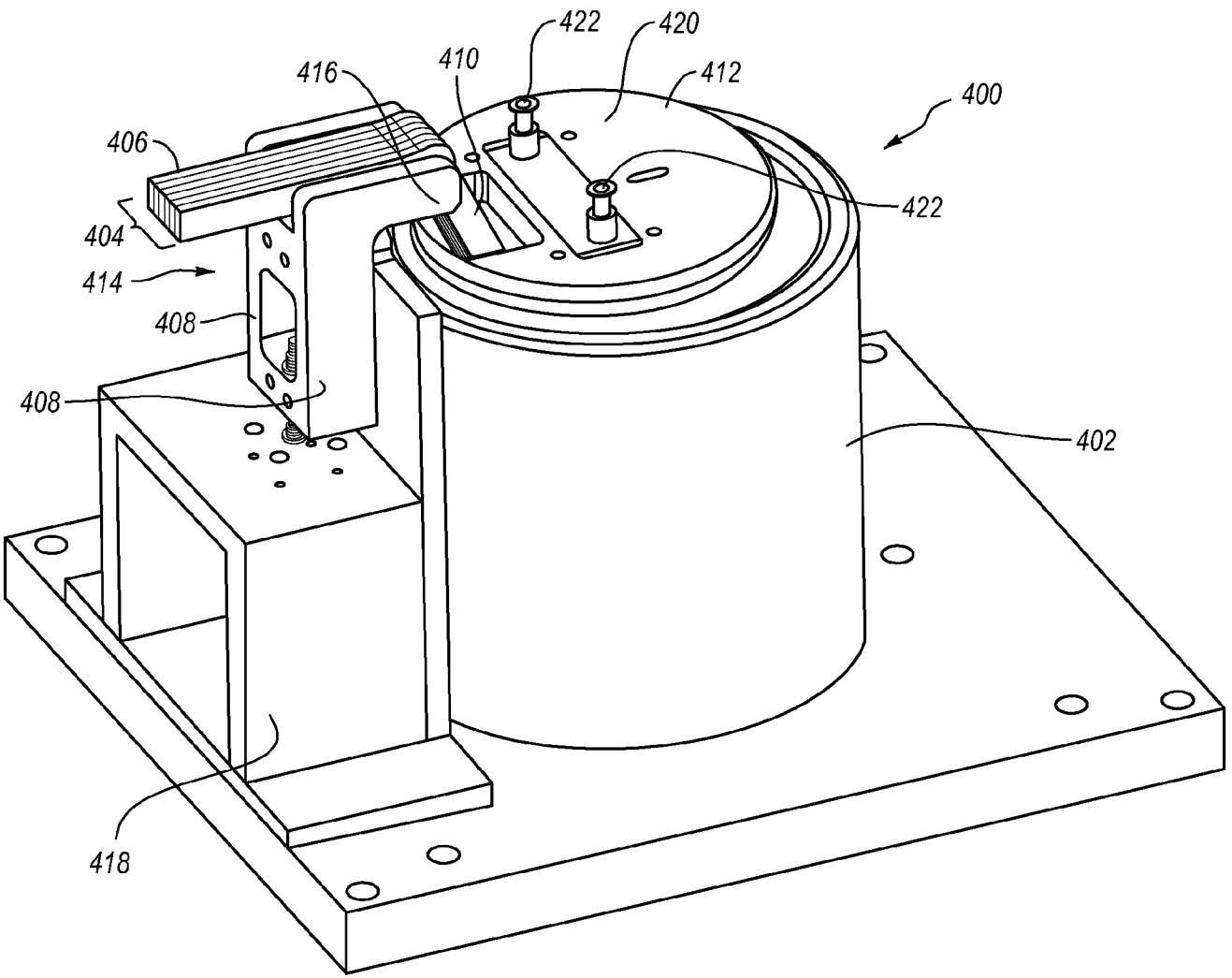
FIG. 4 illustrates an example system effective to electropolish devices such as stents.

FIG. 4 illustrates a system 400 effective to electropolish devices such as stents. FIG. 4 illustrates an electropolishing fixture 414, which is an example of the fixture 300 or the fixture 220, that cooperates with a container 402 (which may alternatively be part of the fixture 414) to electropolish a device. The fixture 414 includes, in one embodiment, a frame 408 configured to hold a pendulum assembly 404. The frame 408 is mounted on a base 418.

The pendulum assembly 404 includes lever arms 406. Each of the fingers 410 of the lever arms 404 extend into an interior of the container 402, which may hold the electrolytic bath, a cathode, or the like. The frame 408 connects with the pendulum assembly 404 at a pivot point 416. The counterweighted proximal ends of the lever arms cause the lever arms 406 to rotate about the pivot point 416. The fixture 414 may also include a frame assembly 412. The frame assembly may be configured to include a cathode and be immersed in an electrolytic bath held in the container 402. The frame assembly 412 includes a top 420 in which contacts 422 are provided. Distal ends of the contacts 422 are configured to receive a mandrel or electrode on which a stent may be loaded. The posts 422 can be connected to an electrical source in order to deliver current to the mandrel.

Figure 5B:
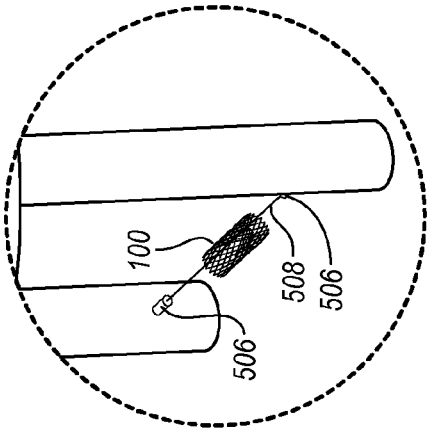
FIG. 5B illustrates an example of stent loaded on an anode between a pair of FIG. 5C illustrates an end view of the pendulum assembly engaging the sent such that the stent can be rotated about the anode.
Figure 5A:
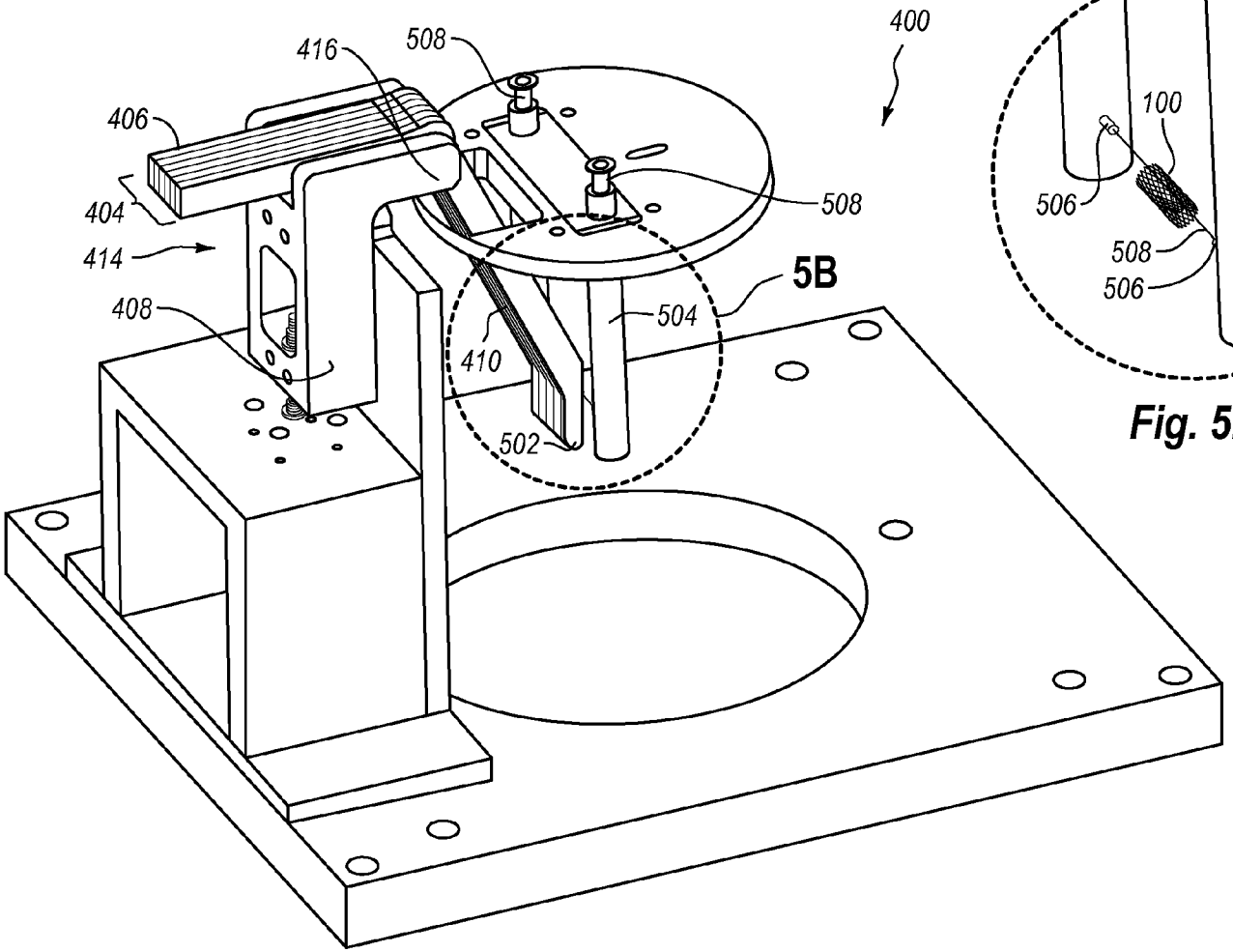
FIG. 5A illustrates an another perspective view of the system shown in FIG. 4 including a view of the pendulum assembly.

FIG. 5A further illustrates the system 400 with the container 402 removed. FIG. 5 illustrates that the fixture 414 may include posts 504, which are connected with the contacts 422. Distal ends of the posts 504 are configured with contacts 506. An electrode 508, on which the stent 100 is loaded, is strung between the contacts 506. The posts 504 are generally insulated and an interior conductor is accessed at contacts 422 outside of the container 402. When an anode is attached to the contacts 506, an electrical source can be connected to the contacts 422 to deliver current to the anode and thus to the loaded stent.

FIG. 5A further illustrates that the distal ends 502 of the fingers 410 may be pressed against the stent due to the counterweighted proximal ends of the lever arms 406, thereby causing a portion of the inside surface of the stent 100 to press against the anode.

FIG. 5B illustrates a view of the stent 100 loaded on the posts 504. FIG. 5B illustrates that movement of the distal ends 502, when pressed against the stent 100 to establish electrical contact between the stent 100 and the anode 508, result in rotation of the stent 100 about the anode 508.

Figure 5C:
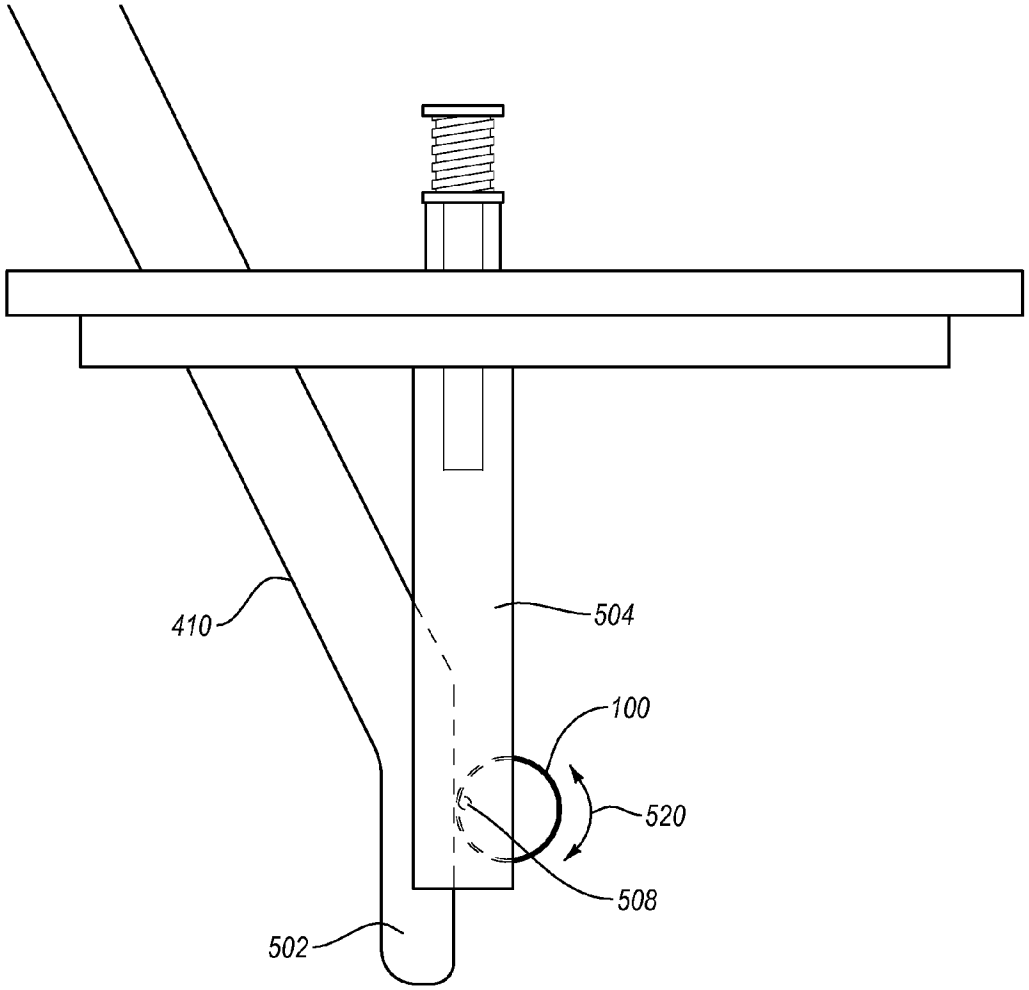

FIG. 5C illustrates a side view of the fixture 414. FIG. 5C illustrates the distal ends 502 pressed against the stent 100 to establish electrical contact between the stent 100 and the anode 508. Movement of the distal ends 502 rotates the stent 100 in the direction 520 in this example.

Figure 6A:
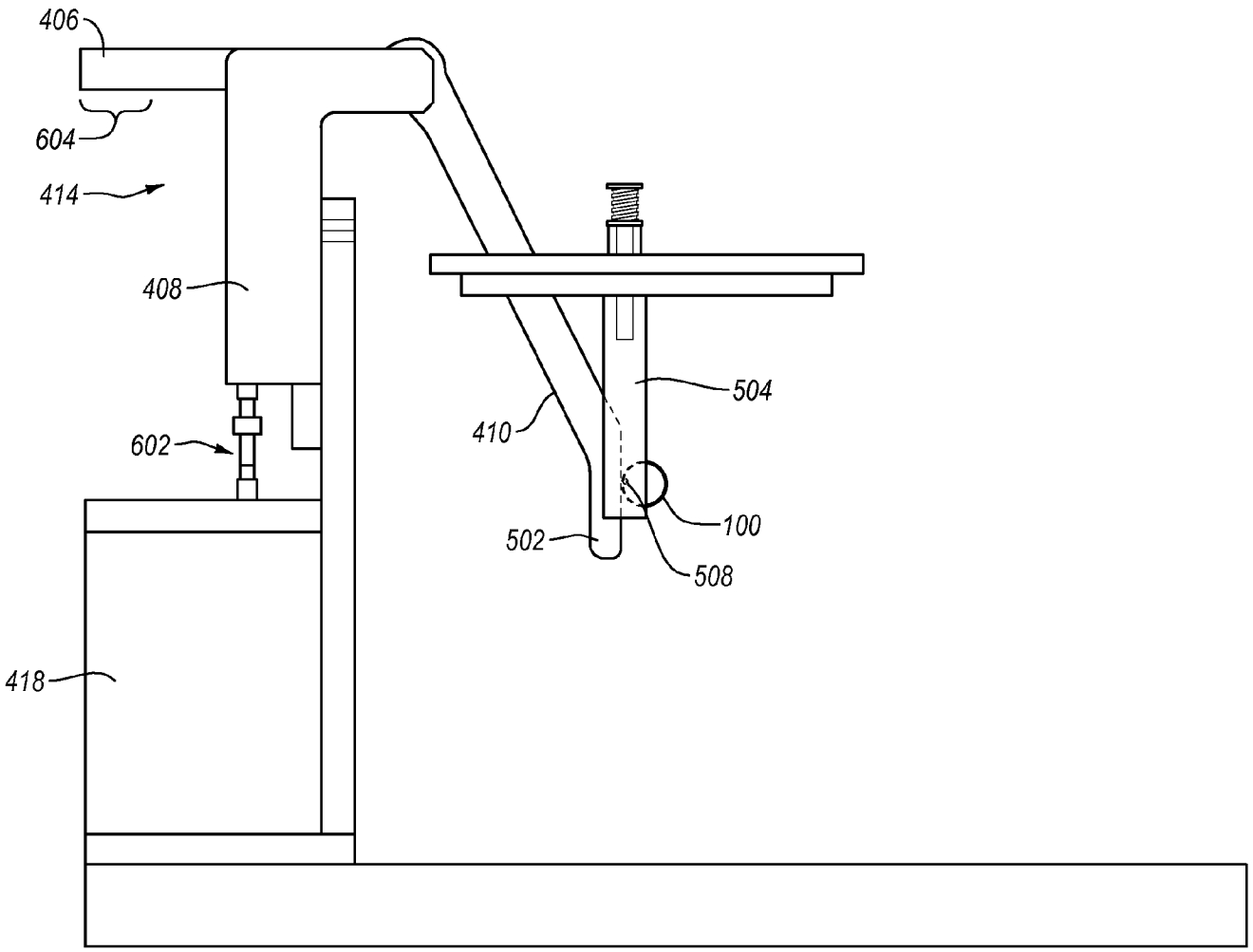
FIGS. 6A and 6B illustrate movement of the electropolishing fixture and more particularly of the pendulum assembly effective to rotate a stent during an electropolishing process.
Figure 6B:
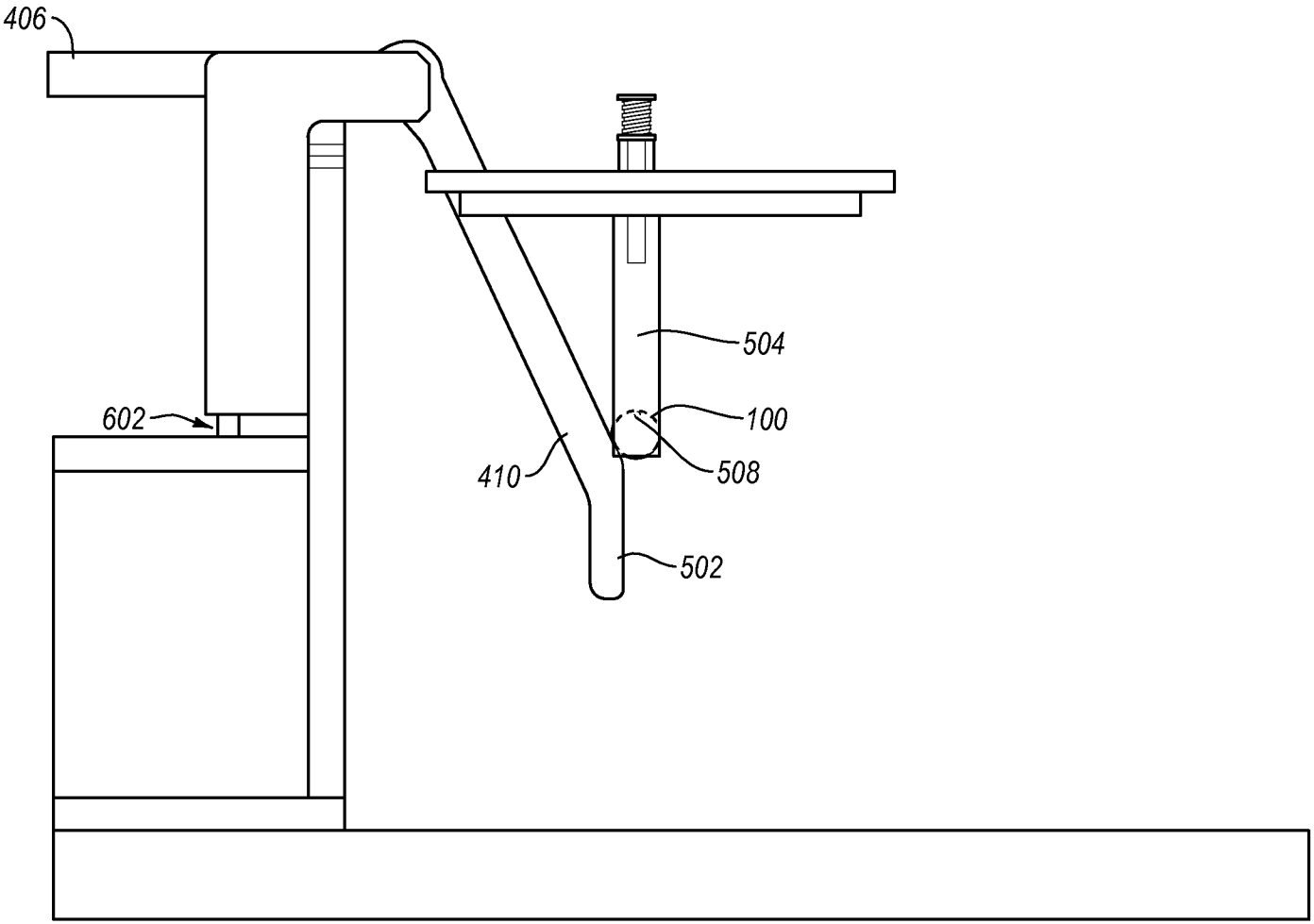

FIGS. 6A and 6B illustrate movement of the electropolishing fixture and more particularly of the pendulum assembly effective to rotate a stent during an electropolishing process. FIGS. 6A and 6B illustrate movement of the fixture during an electropolishing process. FIG. 6A illustrates the fixture 414 in a first or extended or raised position relative to the posts or the anode or the stent or stent assembly. FIG. 6B illustrates the fixture 414 in a second or retracted position or in a lowered position relative to the posts or the anode or the stent or stent assembly. More specifically, FIGS. 6A and 6B illustrate a lift 602, which is an example of a translation mechanism adapted to move the fixture or the pendulum assembly and which may be motorized by a motor mounted in the base 418, that is attached to the frame 408. The lift 602 is operative to move the fixture 414 between a first position and a second position. The lift 602 can be controlled to repeatedly move the fixture between the first and second positions or anywhere inbetween.

As the lift 602 moves the fixture between the first and second positions, the fingers 502 press against a stent arranged, for example, as illustrated in FIG. 3. The lever arms 406 are counterweighted on the proximal ends 604 such that the fingers 410 or distal ends 502 of the lever press against the stent. With movement of the fixture 414, the pressure exerted by the distal ends 502 cause the stent to rotate relative to the anode, while maintaining continuous contact between the stent and the anode.

During the electropolishing process, the stents can thus be rotated by moving the fixture between the first and second positions. The movement of the fixture can be periodic, on a timed basis, or in another manner. The lift 602 may be powered by a motor, hydraulically, pneumatically, or the like and may be controlled by a controller or other computing device.

In FIG. 6A, the lift 602 is extended and in FIG. 6B, the lift 602 is retracted. Controlling the retraction and extension of the lift 602 results in corresponding movement of the fingers 502 up and down relative to the posts, anode, stent and/or stent assembly, which results in repositioning of the stent during the electropolishing process.

Figure 7:
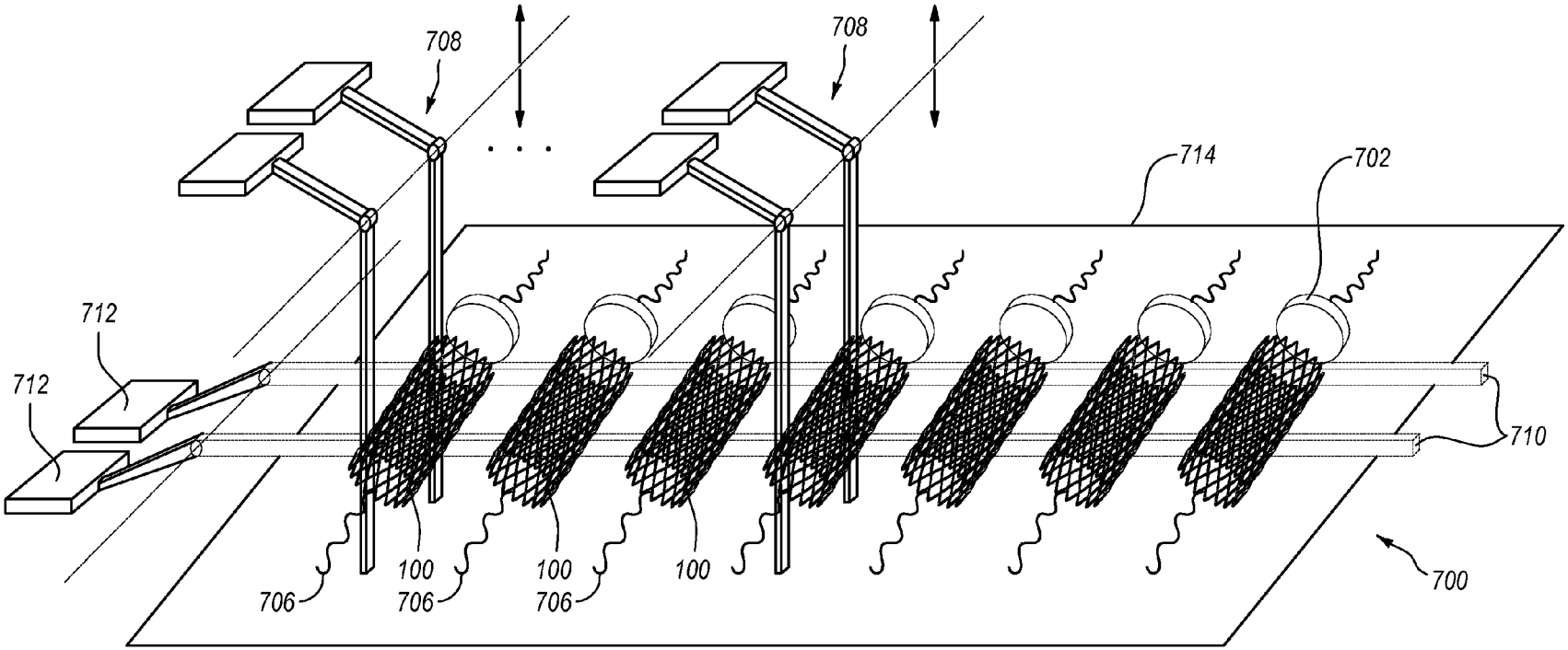
FIG. 7 illustrates an example of a system arranged to electropolish multiple stents simultaneously.

FIG. 7 illustrates an example of a system 700 for electropolishing multiple stents at the same time. In FIG. 7, the stents 100 are loaded on a frame rack 714, which includes a plurality of anodes 706 that extend from one side of the rack 714 to the other side of the rack 714. Current can be supplied to the anodes 706 through the rack collectively or individually.

The stents 100 may be prevented from disengaging anodes 706 in one direction by a stop 702 to aid in handling the stent/anode assembly. The stops 702 may be an overmolded or interference fit portion adapted to cooperate with and position the stents 100 on the anodes 706. When multiple stents are electropolished on a single anode 706, spacers may be placed between adjacent stents, to prevent stent ends from engaging with each other and interfering with each other's electropolish processing or damaging each other. Such spacers may be a slight interference fit or loose on anodes 706. The surface portions of stops 702 and spacers that face the stent ends may have various configurations, such as a flat surface or a surface that over-hangs a portion of the stent end (to limit or prevent stent end ring over-polishing) and or other surfaces/bevels to guide lever arms onto the stent. The cross-sections of stops and spacers may be circular to provide the least friction/wear with the lever arms that they may engage and to facilitate a cylindrically symmetrical electropolishing solution/electrolyte electrical field around the stent, which aides in the uniform electropolishing of the stent. The fixtures 708 are then placed relative to the stents 100 such that the stents 100 can be rotated during the electropolishing process. In one example, the rate of rotation for each stent can be individually controlled. As a result, different stent types can be simultaneously electropolished. In addition, current to each anode 706 can also be individually controlled, which has a corresponding impact on the electropolishing process of each stent 100 individually.

FIG. 7 also illustrates an alternative arrangement of lever arms 710 (shown in phantom for convenience). The lever arms 710 are arranged underneath the stents 100 in this example. As a result, a single fixture including the lever arms 710, which each have a counterweight 712, can be used to rotate each of the stents 100. In this example, a single fixture can be used to rotate multiple stents. FIG. 7 thus illustrates that the lever arms can be oriented between the stents, or laterally with respect to a plane of the stents 100. In each case, the lever arms can be configured such that gravity acts to press the lever arms against the stents.

In some embodiments, each of the lever arms in a fixture are independent and can move independently of other lever arms in the fixture. In one example, the outer most lever arms may be configured to touch the anode and deliver current rather than contact the stent for rotation of the stent. In this case, the distal ends of the current delivering lever arms may have a paddle or other configuration to more effectively deliver current.

Figure 8:
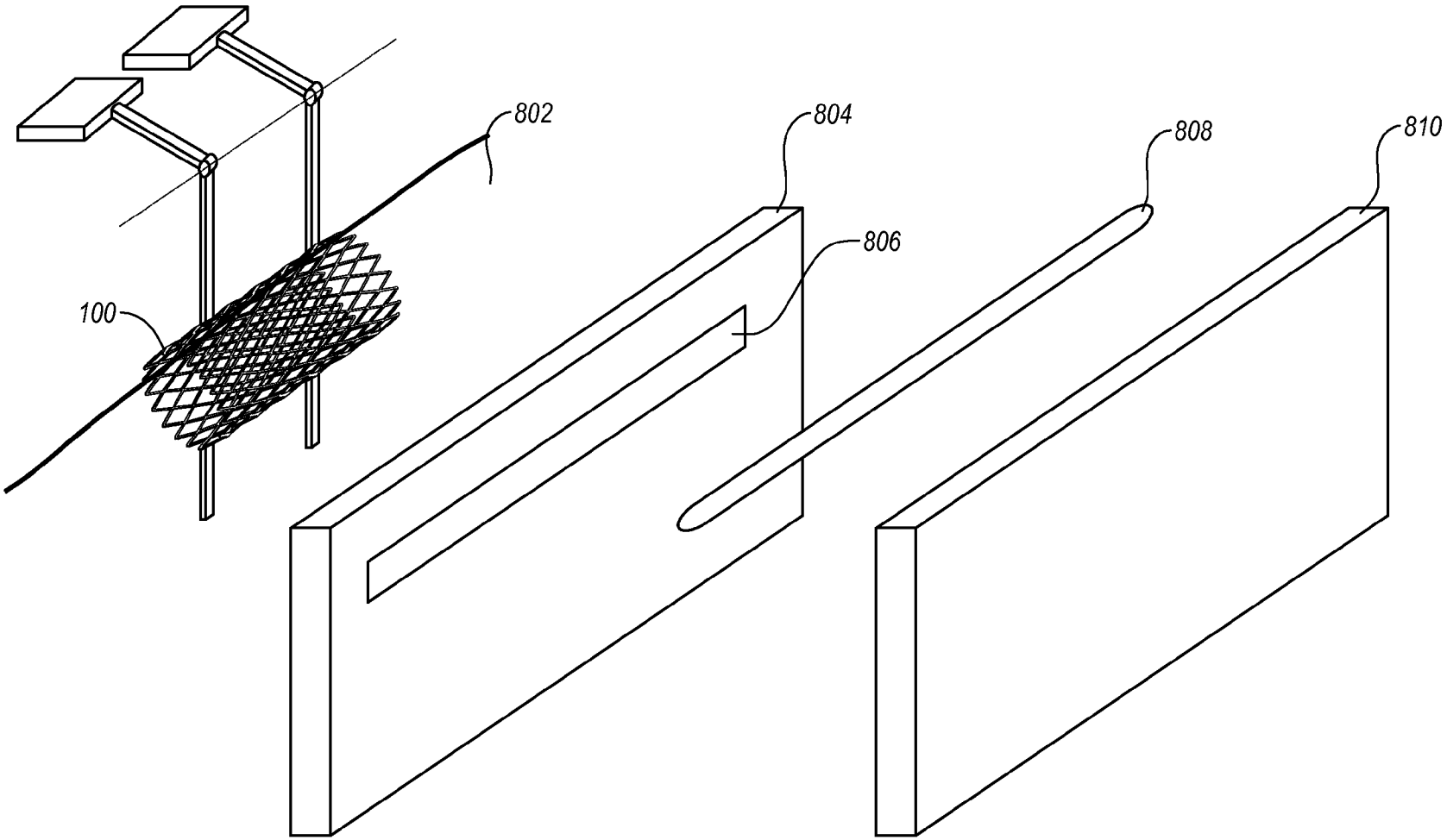
FIG. 8 illustrates an example of controlling an electrical field during an electropolishing process.

FIG. 8 illustrates an example of a system for controlling an electrical field during an electropolishing process. FIG. 8 illustrates the stent 100 mounted on a mandrel or anode 802 in this example by passing the anode 802 through the lumen 120 of the stent 100. A cathode 808 is also illustrated. During the electropolishing process, current passes from the anode 802 to the stent 100 by contact and from the stent 100 to the cathode via the electrolytic bath in which the stent 100, the anode 802 and the cathode 808 may be immersed.

FIG. 8 illustrates shielding 804 and shielding 810, which may be configured of PTFE. In this example, the shielding 804 has a window 806. By controlling or setting the relative placements or locations of the stent 100, anode 802, shielding 804, window 806 (and/or shape thereof), cathode 808 (and/or shape thereof), and/or shielding 810 (and/or shape thereof), an electric field generated during the electropolishing process can be controlled. Controlling the electric field (or current path) can be used to more effectively control the electropolishing process. The cathode 808 may be completely shielded except for the window 806 (encased within the shielding), or partially shielded as illustrated in FIG. 8. Further, the cathode 808 may be a rod, a plate, a mesh plate or have another configuration that is larger than the window 806 and smaller than the shielding 804 and 810.

FIG. 8 further illustrates that the shape, configuration, and or placement of the shielding 804, 810 and/or of the cathode can thus be optimized for effective electropolishing. Like other embodiments disclosed herein, the cathode 808 may be a wire, a wire mesh, placed on one or more sides of the stent 100, or the like.

The window 806 can be an integral part of the shielding 804. Alternatively, the shielding 804 may be composed of movable panels. Two moveable panels (or a situation where one panel is fixed and the other panel is moveable) can be positioned in a manner to control the size and/or orientation of the window 806. The panels may be placed in guides such that the panels can be slid towards each other. The panels may be held in place by friction between the panels and the guides. In addition, the size and/or location of the window 806 can be changed during the electropolishing process.

Figure 9:
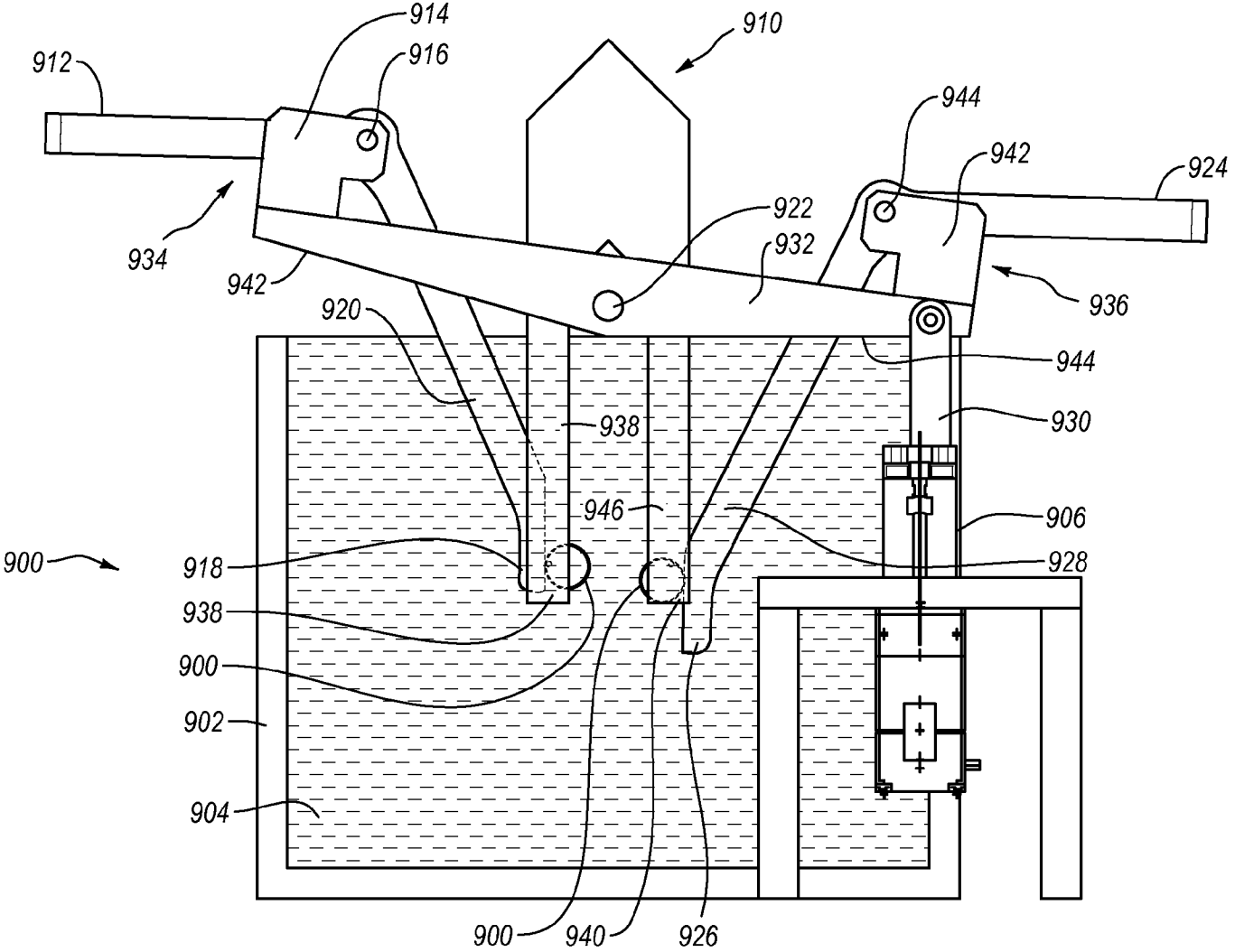
FIG. 9 illustrates another example of an electropolishing system that includes multiple electropolishing fixtures.

FIG. 9 illustrates an example of an electropolishing system 900 configured for electropolishing devices. FIG. 9 illustrates another example of an electropolishing system that includes multiple electropolishing fixtures. The electropolishing system 900 includes multiple fixtures, including the fixture 934 and the fixture 936. The fixtures 934 and 936 are arranged on opposing sides of a center frame 910. Posts 938 and 940, which may be part of the center frame 910, may extend into the bath 904 and are configured to hold stents. More specifically, each of the fixtures 934 and 936 may associate with a pair of posts between which an anode is attached. As previously stated, one or more stents may be loaded on each mandrel or anode that is connected to each pair of posts.

FIG. 9 also illustrates a cathode assembly 946. The cathode assembly 946 can include a cathode of any appropriate shape (e.g., rod, plate, mesh plate) and/or shielding in one example. The cathode in the cathode assembly 946 may also be configured to be located on one or more sides of the stents 100. For example, the cathode assembly 946 may be configured like the cathode 808 illustrated in FIG. 8. The cathode 808 could be placed between the posts 938 and 940 as illustrated in FIG. 9. The shielding 804 and/or 810 could also be included in the system cathode assembly 946. With a cathode assembly 946 placed between the posts 938 and 940, the cathode assembly 946 may include shielding with a window (such as the shielding 804) can be provided for each fixture 934 and 936. The shielding can be placed on either side of the cathode. As a result, the windows in the shielding on opposite sides of the cathode could face the stents loaded on the fixtures 934 and 936. Because the system 900 can include multiple fixtures or multiple rows of fixtures, the cathode assembly 946 can be arranged to facilitate the electropolishing process.

For example, a cathode assembly can be provided for each stent or for opposing pairs of stents. Alternatively, the cathode assembly could be elongated to accommodate each row of fixtures. In this example, a single cathode could be used for all fixtures in the system 900. In this example, the shielding can be configured with multiple windows (e.g., one for each stent or multiple windows for each stent).

The frame 914 of the fixture 934 is connected to the frame 942 of the fixture 936 by a rocking arm 932. The rocking arm 932 is configured to rotate about an axis 922. In this example, the rocking arm 932 rotates back and forth and is actuated by an actuator 906. The actuator 906 connects with the rocking arm 932 by a push rod 930. The push rod 930 is connected to both the actuator 906 and one end of the rocking arm 932. The rocking arm may include sides 942 and 944 that are slanted. The angle of slant may be configured to correspond to the movement of the lift or actuator 906. When fully retracted, in one example, the side 944 may rest on the container 902, although this is not required. Rather, the sides 942 and 944 are configured or sloped relative to the container such that the rocking arm 932 can rock according to movement of the actuator 906. If there is sufficient clearance between the container 902 and the rocking arm 932, there may be no need to slope the sides 942 and 944.

The actuator 906 may be electrically, pneumatically, or hydraulically powered or the like or any combination thereof. When operating, the actuator 906 moves the push rod 930 up and down. The connection between the push rod 930 and the rocking arm 932 may allow for relative movement or rotation. When the push rod 930 moves to an extended position, the fixture 936 is moved upwards by the rocking arm 932 and the fixture 932 is simultaneously moved downward by the rocking arm 932.

As the actuator 906 moves the push rod 930 reciprocatively, the rocking arm 932 rocks or rotates back and forth around the axis 922 to translate the fixtures 932 and 936 between first and second positions (e.g., an up position and a down position).

The fixture 934 includes lever arms 912 that rotate about an axis 916 and that are mounted to the frame 914. Because the lever arms 912 are weighted at the proximal ends, as previously described, the distal ends 918 of the fingers 920 press against the stents 100 loaded on the mandrel or anode, which extends between the posts 938 and between the posts 940 on the other side of the system in FIG. 9. The movement of the fingers 920 thus rotate the stent relative to the anode or mandrel on which the stent is loaded. The fixture 936 includes lever arms 924 that rotate about an axis 948 such that the proximal weighted ends cause, by gravity in one example, the distal ends 926 of the fingers 928 to press against the stent loaded in the posts 940.

The center frame 910 may be configured to anchor the rocking arm 932 to the container or housing 902. The frame 910 may be configure such that the posts 938 and 940 can be immersed in and removed from the bath 904. This enables the stents to be loaded as necessary in one example. The frame 910 may be connected with the container 902 during the electropolishing process by a latch, by weight or other suitable connection. In addition, the frame 910 may be configured such that a current can be delivered to the anodes strung, as appropriate, between the posts 938 or the posts 940. More specifically, anodes are strung between the posts 940 for the fixture 936 and are strung between the posts 938 for the fixture 934. In this manner, multiple stents can be electropolished simultaneously.

Figure 10:
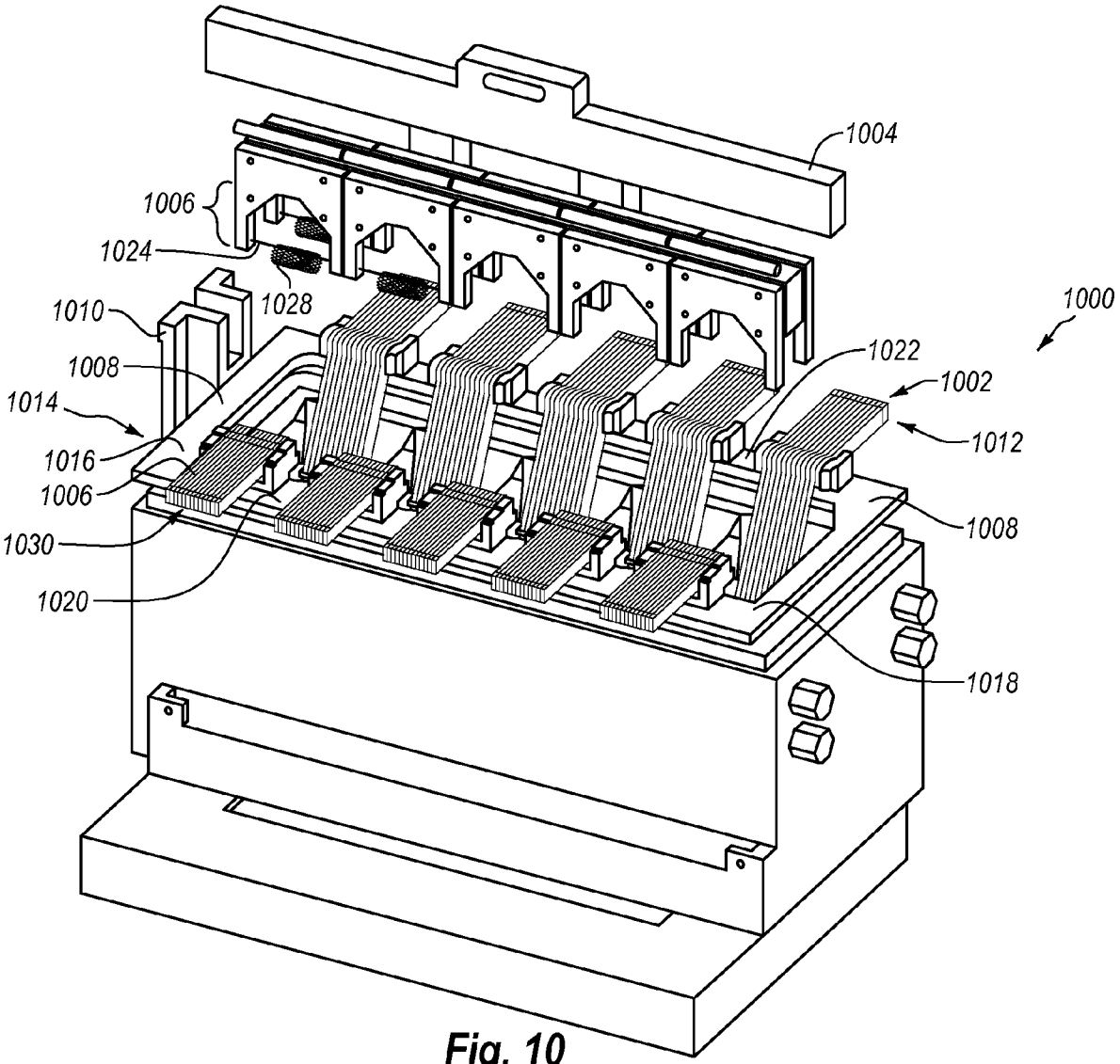
FIG. 10 illustrates a perspective view of an electropolishing system configured to simultaneously electropolish multiple stents.

FIG. 10 illustrates a perspective view of an electropolishing system 1000 configured to simultaneously electropolish multiple stents. The system 1000 includes a plurality of fixtures 1002, each of which may be one of the fixtures disclosed herein. The system 1000 is an extension of the system 900 shown in FIG. 9. Where FIG. 9 included at least two fixtures, the system 1000 includes at least a row 1012 of fixtures and a row 1014 of fixtures. The row 1012 of fixtures are opposite the row 1014 of fixtures. As illustrated in FIG. 9, a cathode assembly may be placed between rows of fixtures during the electropolishing process or placed in another location.

In the system 1000, movement of the row 1012 and the row 1014 is controlled by the rocking arm 1008. The rocking arm 1008 includes a first end 1016 and a second end 1018 that are connected by sides 1020 and 1022. The side 1020 is connected to each frame of each fixture in the row 1014. The side 1022 is connected to each frame of each fixture in the row 1012. As the rocking arm 1008 rocks, the sides 1020 and 1022 move up and down, which motion is transferred to the rows of fixtures. Thus, the teeter-totter type movement of the rocking arm 1008 causes the fixtures in the rows 1012 and 1014 to rotate the stents mounted on the mandrels or stents that are attached to the rows of posts 1006. By way of example, FIG. 10 illustrates an anode 1024 on which is loaded the stent 1028. The stent 1028 is rotated by a corresponding fixture 1030. Other pairs of posts in the row of posts 1006 are similarly configured with anodes. When the row 1006 of posts is lifted up, the anodes can be loaded/removed from the anodes. When loaded, the row 1006 of posts is then dropped into the bath and the frame 1004 may hold the rows 1006 of posts in place during the electropolishing process.

The center frame 1004 cooperates with a frame portion 1010 such that the row of posts 1006 can be inserted/withdrawn from an electrolytic bath. Once the stents are loaded, the center frame 1004 is lowered into the bath with the stents loaded on the anodes are electropolished. The system is then actuated such that the fixtures in the rows 1012 and 1014 reposition the stents loaded thereon during the electropolishing process.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. An electropolishing fixture for electropolishing a device, the fixture comprising:

a pendulum assembly including a lever arm, the lever arm having a proximal end and a distal end, the distal end including a finger configured to directly contact the device with a surface of the finger, the proximal end having a counterbalance, and the lever arm being pivotally movable about a point located between the distal end and the proximal end; and a translation mechanism configured to selectively raise and lower the pendulum assembly relative to the device, wherein the finger of the lever arm moves in a tangential direction relative to the device to rotate the device during movement of the pendulum assembly.

2. The electropolishing fixture of claim 1, further comprising a frame, wherein the pendulum assembly is connected to the frame at a pivot point, wherein the lever arms rotate about the pivot point.

3. The electropolishing fixture of claim 1, wherein the proximal end includes a counterweight configured to cause the lever arm to rotate about a pivot point and press the distal end against the device.

4. The electropolishing fixture of claim 1, further comprising an anode assembly configured to hold the device during the electropolishing process.

5. The electropolishing fixture of claim 4, wherein the anode assembly includes an anode and a pair of posts, wherein the anode is removably connected with the pair of posts and wherein an electrical current is supplied to the anode via the pair of posts.

6. The electropolishing fixture of claim 5, wherein the device is loaded on the anode by inserting the anode through a lumen of the device, wherein the device fits loosely on the anode.

7. The electropolishing fixture of claim 6, wherein the lever arm presses the device against the anode to establish electrical contact between the anode and the device.

8. The electropolishing fixture of claim 1, wherein the pendulum assembly includes a plurality of lever arms, wherein each lever arm is configured for movement independent of the other lever arms.

9. The electropolishing fixture of claim 8, wherein at least one of the plurality of lever arms is configured to deliver current to the device for electropolishing.

10. The electropolishing fixture of claim 9, wherein the lever arm configured to deliver current includes a pad on the distal end that is configured to contact a conductive anode passing through a lumen of the device.

11. An electropolishing fixture for electropolishing a device, the fixture comprising:

a pendulum assembly including a plurality of lever arms, each lever arm is configured for movement independent of the other lever arms, each lever arm having a proximal end and a distal end, the distal end of a plurality of the plurality of lever arms including a finger configured to contact the device, the proximal end having a counterbalance, and the lever arm being pivotally movable about a point located between the distal end and the proximal end, at least one of the plurality of lever arms is configured to deliver current to the device for electropolishing and includes a pad on the distal end that is configured to contact a conductive anode passing through a lumen of the device; and a translation mechanism configured to move the pendulum assembly in at least one direction, wherein the finger of the lever arm rotates the device during movement of the pendulum assembly.

12. The electropolishing fixture of claim 11, further comprising a frame, wherein the pendulum assembly is connected to the frame at a pivot point, wherein the plurality of lever arms rotates about the pivot point.

13. The electropolishing fixture of claim 12, wherein the proximal end includes a counterweight configured to cause the plurality of lever arms to rotate about a pivot point and press the distal end against the device.

14. The electropolishing fixture of claim 13, further comprising an anode assembly configured to hold the device during the electropolishing process.

15. The electropolishing fixture of claim 14, wherein the anode assembly includes an anode and a pair of posts, wherein the anode is removably connected with the pair of posts and wherein an electrical current is supplied to the anode via the pair of posts.

16. The electropolishing fixture of claim 15, wherein the device is loaded on the anode by inserting the anode through a lumen of the device, wherein the device fits loosely on the anode.

17. The electropolishing fixture of claim 16, wherein the plurality of the plurality of lever arms press the device against the anode to establish electrical contact between the anode and the device.

18. The electropolishing fixture of claim 17, further comprising a shielding and a cathode, wherein the shielding is oriented with respect to the cathode and an anode so as to control an electric field while electropolishing the device.

19. The electropolishing fixture of claim 18, wherein the shielding can be reconfigured during the electropolishing to change the electric field.

* * * * *